US010032556B2

(12) United States Patent
Bachinger et al.

(10) Patent No.: US 10,032,556 B2
(45) Date of Patent: Jul. 24, 2018

(54) DC COMPENSATION FOR HIGH DC CURRENT IN TRANSFORMER

(71) Applicant: SIEMENS AKTIENGESELLSCHAFT, Munich (DE)

(72) Inventors: Florian Bachinger, St. Georgen/Gusen (AT); Patrik Ernst, Muehlhausen (DE); Peter Hamberger, Kirchschlag Bei Linz (AT); Clemens Keplinger, Linz (AT); Juergen Lottes, Nuremberg (DE); Georg Pilz, Poxdorf (DE); Markus Wiesinger, Forchheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/126,348

(22) PCT Filed: Mar. 19, 2014

(86) PCT No.: PCT/EP2014/055500
§ 371 (c)(1),
(2) Date: Sep. 15, 2016

(87) PCT Pub. No.: WO2015/139743
PCT Pub. Date: Sep. 24, 2015

(65) Prior Publication Data
US 2017/0084386 A1 Mar. 23, 2017

(51) Int. Cl.
*H01F 27/42* (2006.01)
*H01F 27/34* (2006.01)
*G05F 3/08* (2006.01)

(52) U.S. Cl.
CPC ..... *H01F 27/42* (2013.01); *G05F 3/08* (2013.01); *H01F 27/34* (2013.01)

(58) Field of Classification Search
CPC ..... H01F 27/42; H01F 27/34; G05F 3/08
(Continued)

(56) References Cited

U.S. PATENT DOCUMENTS 5,099,410 A * 3/1992 Divan ..... H02J 9/062 318/811
5,270,913 A * 12/1993 Limpaecher ..... H02J 3/18 307/109
(Continued)

FOREIGN PATENT DOCUMENTS

CN 102985838 A 3/2013
CN 103270561 A 8/2013
(Continued)

OTHER PUBLICATIONS

Received STIC search report from EIC 2800 searcher John DiGeronimo dated May 24, 2017.*
(Continued)

*Primary Examiner* — Timothy J Dole
*Assistant Examiner* — Htet Z Kyaw
(74) *Attorney, Agent, or Firm* — Laurence Greenberg; Werner Stemer; Ralph Locher

(57) ABSTRACT

A system for compensating one or more DC components in an electrical system includes one or more sensors for sensing the one or more DC components. The system also includes one or more DC component controllers for generating one or more reference signals from one or more signals received from the one or more sensors. In addition to this, the system also has one or more controllers for generating one or more firing pulses from the one or more reference signals received from the one or more DC component controllers and one or more valve configurations for charging one or more controllable branches to counterbalance the one or more DC components of the electrical system. A method for compen-
(Continued)

sating one or more DC components in an electrical system is also provided.

9 Claims, 1 Drawing Sheet

(58) Field of Classification Search
USPC ..... 323/356
See application file for complete search history.

(56) References Cited

U.S. PATENT DOCUMENTS

| | | | | |
|---|---|---|---|---|
| 9,046,901 | B2 | 6/2015 | Hamberger et al. | |
| 2004/0196675 | A1 | 10/2004 | Cope et al. | |
| 2010/0194373 | A1* | 8/2010 | Hamberger | H01F 27/34 323/356 |
| 2013/0049751 | A1 | 2/2013 | Hamberger et al. | |
| 2013/0201592 | A1 | 8/2013 | Hamberger et al. | |
| 2017/0214310 | A1* | 7/2017 | Zhang | H02M 1/083 |

FOREIGN PATENT DOCUMENTS

| | | | |
|---|---|---|---|
| CN | 103765743 | A | 4/2014 |
| GB | 2013000 | A | 8/1979 |

OTHER PUBLICATIONS

Hamberger, P. Ernst, et al. "Mitigation of GIC Impacts in Power Transformers and SVC installations" 2013 CIGRE Canada Conference , Calgary, Alberta, Sep. 9-11, 2013; 2013.

* cited by examiner

DC COMPENSATION FOR HIGH DC CURRENT IN TRANSFORMER

BACKGROUND OF THE INVENTION

Field of the Invention

The present invention relates to a method and system for DC compensation in transformer and more particularly, to a method and system for DC compensation for high DC current in transformer cores.

In an electrical power grid, a transformer is coupled between an AC power system and a converter. DC currents in the electrical power grid can negatively affect the transformer. In principle the time derivative of the magnetic flux in the core of the transformer is proportional to the voltages at the transformer terminals. In an ideal operation condition i.e. when no DC currents are affecting the core of the transformer, terminal voltage and load current of the transformer are sinusoidal in nature and symmetrical in polarity. Hence the magnetic flux is also symmetrical i.e. the positive and negative half cycles of the magnetic flux are symmetrical resulting in equal magnetic forces in both the half cycles within the transformer.

On the other hand, if the load current of the transformer contains DC current components, a DC offset caused in the magnetic flux will lead to transformer saturation. Due to the DC offset of the magnetic flux, the positive and negative half cycles of the magnetic flux become asymmetrical i.e. one half cycle will drive toward saturation and the other half cycle experiences less stress than it is designed for.

From the foregoing, it is evident that DC components in the transformer core lead to an increase in noise levels, high reactive power consumption and also increase in no-load losses. Typical source of the DC components are GIC (geomagnetically induced currents), power electronics within network networks like SVC (static VAR compensation)/STATCOM units and/or HVDC transmission systems.

Various methods are mentioned in the state of the art for compensating or for reducing the effects of the DC components within an electrical power system. One most commonly practiced method for compensating the DC components within the transformer core is to use a sensor and a compensation winding along with the transformer winding. In this method, the sensor is placed over the core of the transformer. The sensor measures the time derivative of the magnetic voltage of the transformer core and compares the positive and negative half cycle for detecting the DC offset. Based on the comparison, the sensor sends a bipolar voltage signal to DC compensation (DCC) unit placed outside the transformer. The DCC unit is a system for active compensation of the DC components by the controlled injection of DC ampere-turns, acting against the DC ampere-turns originating from the DC biased load current. In other words, based on the bipolar voltage received from the sensor, the DCC unit injects an AC current with superimposed DC component by phase-controlled switching of a power circuit consisting of the compensation winding also known as auxiliary transformer winding, a reactor and the DCC unit's power part itself.

The above mentioned method for DC compensation takes care of small DC currents introduced within the electrical systems and eliminated the noise increased due to the DC currents. However the method is not suitable for high DC components especially like geomagnetically induced currents (GIC) that significantly increase excitation power. The increase in the excitation power due to high DC components sometime lead to overheating of the transformer core and also increase in eddy current losses in transformer winding and metal parts of the transformer. Techniques known in the state of the art for high DC components compensation is to either use a thermally over-dimensioned transformer or use a DC blocking system within the transformer. The techniques suggested in the state of the art only helpful in protecting the device from the effects of high DC currents and there is no technical solution available for compensating the high DC currents specially GICs within the transformer.

In the light of the foregoing it is clearly evident that there is a strong need of an efficient system and a method for compensating high DC currents within the transformer.

BRIEF SUMMARY OF THE INVENTION

It is therefore an objective of the present invention to provide an economical and efficient system and method for DC currents compensation within a transformer.

The objective is achieved by providing a method for compensating one or more DC components in an electrical system and a system for compensating one or more DC components in an electrical system as described below. Further embodiments of the present invention are addressed in the dependent claims.

In a first aspect of the present invention, a method for compensating one or more DC components in an electrical system is disclosed. In accordance to the method of the present invention, at a first step of the method one or more signals are derived from the one or more DC components and the one or more signals are received at one or more controllers. Then the one or more signals are converted to one or more firing pulses. The one or more firing pulses are used for triggering one or more valve arrangements. One or more controllable branches/devices are adapted to the one or more dc components in the electrical system. The control adapts by the one or more controllable branches/devices counterbalance the one or more DC components of the electrical system.

Further, in accordance with the first aspect of the present invention, one or more sensors sense the one or more DC components and convert the one or more DC components in the one or more signals before the one or more controller receives the one or more signals.

Furthermore, in accordance with the first aspect of the present invention, the one or more firing pulses are synchronized according to the fundamental frequency and one or more phases associated with the one or more valve arrangements before triggering the one or more valve arrangements.

In a second aspect of the present invention, a system for compensating one or more DC components in an electrical system is disclosed. The system comprises one or more sensors for sensing the one or more DC components. The system also comprises one or more DC component controllers for generating one or more reference signal from one or more signals received from the one or more sensors. In addition to this, the system also has one or more controllable branches/devices for generating one or more firing pulses from the one or more reference signal received from the one or more DC component controllers to adapt one or more branches/devices to counterbalance the one or more DC components of the electrical system.

In accordance with the second aspect of the present invention, the system further comprises one or more trigger set for synchronizing the one or more firing pulses received from the one or more controllers.

Accordingly, the present invention provides an effectively and an economically method and system for compensating one or more DC components in an electrical system.

BRIEF DESCRIPTION OF THE SEVERAL VIEWS OF THE DRAWING

The present invention is further described hereinafter with reference to illustrated embodiments shown in the accompanying drawings, in which.

DESCRIPTION OF THE INVENTION

Figure 1:
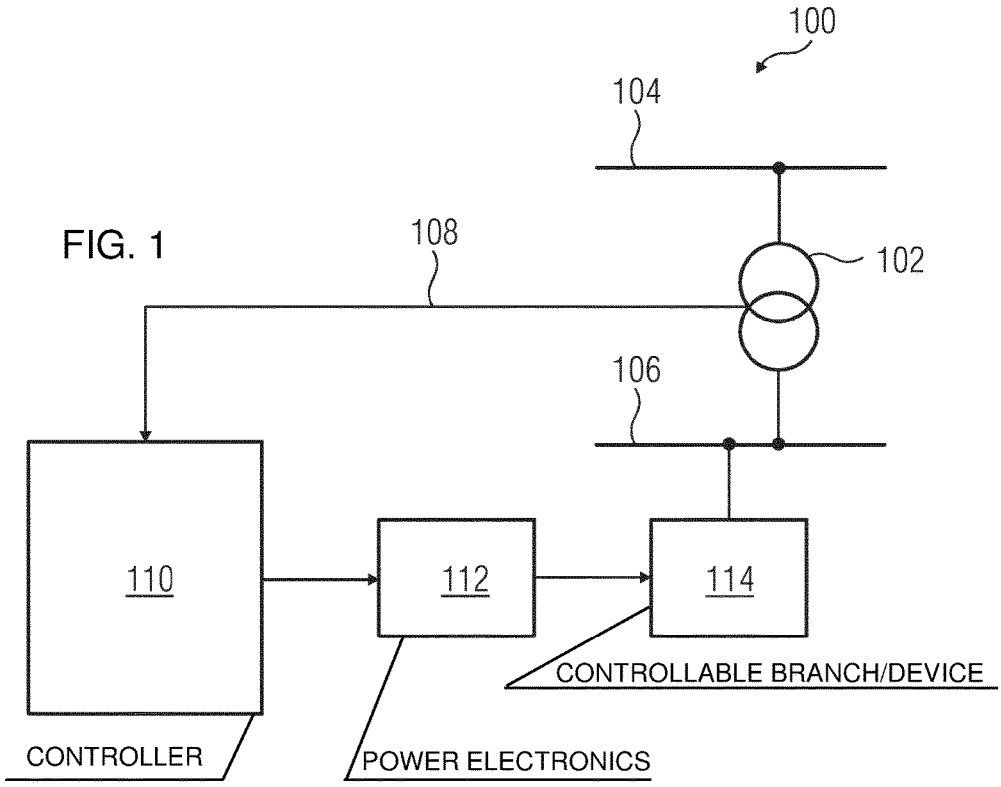
FIG. 1 illustrates a block diagram of DC compensation system in accordance with an embodiment of the present invention.

Various embodiments are described with reference to the drawings, wherein like reference numerals are used to refer to like elements throughout. In the following description, for purpose of explanation, numerous specific details are set forth in order to provide a thorough understanding of one or more embodiments. It may be evident that such embodiments may be practiced without these specific details.

FIG. 1 illustrates a block diagram of the DC compensation system 100 in accordance with an embodiment of the present invention.

The DC compensation system 100 includes a transformer 102, a high voltage line 104, a low voltage line 106, a controller 110, a power electronic 112 and a controllable branch/device 114. A sensor, not shown in FIG. 1, is connected on top of the core of the transformer 102. The sensor measures the magnetic voltage at the core of the transformer 102 and compares the positive and negative half cycle for detecting the DC components. Based on the comparison, the sensor sends a bipolar voltage signal to the controller 110 through a connection 108, as shown in FIG. 1. Working principle and type of the sensor at the core of the transformer 102, for detecting the DC components is well known in the state of the art.

The controller 110 receives bipolar voltages sensed by the sensor at the core of the transformer 102 through the connection 108. The controller 110 converts the received bipolar voltages to firing pulses i.e. one for each phase and sends it to the power electronic 112. Detailed operation of the controller 110 is described in FIG. 2. The power electronic 112 triggered according to the firing pulses and the controllable branch/device 114 compensates DC components present in the transformer 102, as the controllable branch/device 114 connected in series with the transformer 102 via the low voltage line 106, as shown in FIG. 1.

In a preferred embodiment of the present invention, the power electronic 112 could be a thyristor valve consists of anti-parallel-connected pairs of thyristors connected in series. The controllable branch/device 114 could be an arrangement of three delta connected coils controlled by the thyristor valve. Each coil of the reactor 114 is connected to a phase winding of the three phase transformer 102. In an embodiment of the present invention, the valve arrangement 112 and the reactor 114 are part of a thyristor controlled reactor (TCR).

Figure 2:
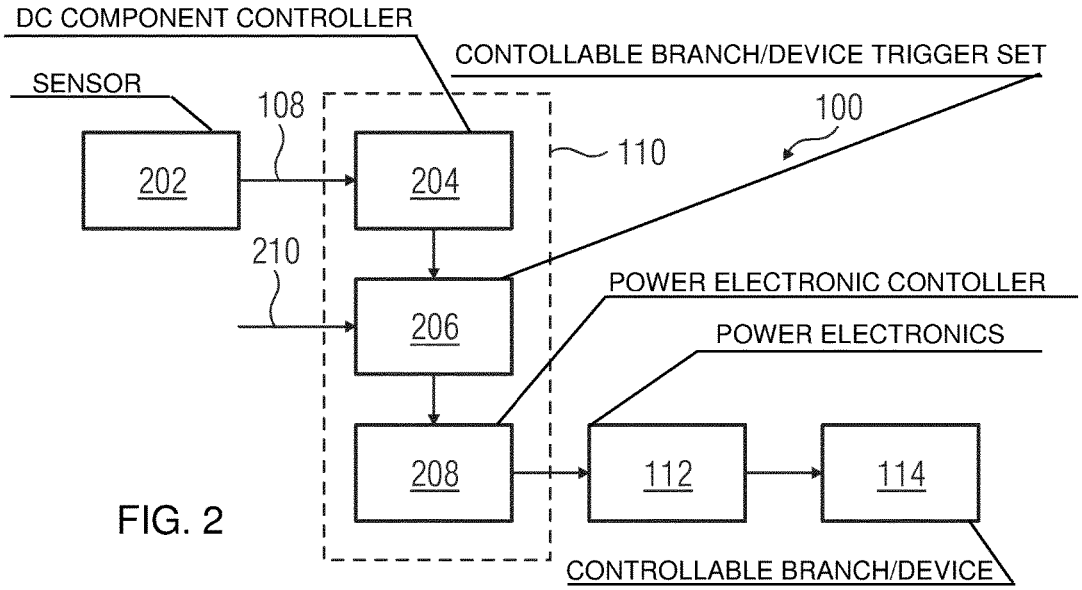
FIG. 2 illustrates a detailed view of DC compensation system in accordance with an embodiment of the present invention.

FIG. 2 illustrates a detailed view of the DC compensation system 100 in accordance with an embodiment of the present invention.

The DC compensation system 100, illustrated in FIG. 2, comprises a sensor 202, a DC component controller 204, a power electronic controller 208, a controllable branch/device trigger set 206, the power electronic 112 and the controllable branch/device 114. The DC component controller 204, the power electronic controller 208 and the controllable branch/device trigger set 206 are sub modules of the controller 110 shown in FIG. 1. The sensor 202 is placed on top of the core of the transformer 102 as explained in FIG. 1. The sensor 202 senses the DC components present within the transformer 102 and transmit the bipolar voltage signal to the DC component controller 204 through the connection 108. The bipolar voltage signal is a measure of presence of DC components in the load current of the transformer 102 of FIG. 1. The DC component controller 204 receives bipolar voltage signal and converts it to a required branch/device reference signal which is comparable to the DC components measured by the sensor 202. In addition to this, the DC component controller 204 also prevents unbalanced magnetisation of transformers and consequent second harmonic instability hence eliminates the DC components from the received bipolar voltage signal. The power electronic controller 208 receives the required branch/device reference signal from the DC component controller 204. In addition to this, the power electronic controller 208 also receives a reference signal through connection 210, as shown in FIG. 2. The power electronic controller 208 performs a conversion of received branch/device reference signal signals to firing pulses i.e. one for each phase and transmits the firing pulses to the trigger set 206. The trigger set 206 synchronizes the firing pulses for synchronisation.

The power electronic arrangement 112 receives synchronized firing pulse from the trigger set 206. The power electronic arrangement 112 triggered according to the synchronized firing pulses and the controllable branch/device 114 compensates DC components present in the core of the transformer 102 i.e. measured by the sensor 202. The DC compensation is performed as the controllable branch/device 114 connected in series with the transformer 102 via the low voltage line 106, as shown in FIG. 1.

It is evident from the foregoing description that the present invention provides a system and a method for compensating DC currents within the transformer with a controllable branch/device.

The system and the method for compensating DC currents disclosed in the present invention eliminates the need of the compensation winding within the transformer, as suggested in the state of the art. Due to the absence of the compensation winding from the transformer core, the system and method disclosed in the present invention is also useful for compensating high DC currents like geomagnetically induced currents (GIC).

The disclosed system and method of compensating the DC currents also eliminates the need of designing overdimensioned transformers and equipment or using DC blocking system within the transformer with a controllable branch/device.

Hence it is clear that the disclosed invention presents an efficient and economical system and method for compensating DC components present within a transformer of an electrical system.

While the present invention has been described in detail with reference to certain embodiments, it should be appreciated that the present invention is not limited to those embodiments. In view of the present disclosure, many modifications and variations would present themselves, to those of skill in the art without departing from the scope of various embodiments of the present invention, as described herein. The scope of the present invention is, therefore, indicated by the following claims rather than by the foregoing description. All changes, modifications, and variations coming within the meaning and range of equivalency of the claims are to be considered within their scope.

LIST OF REFERENCES

100 DC COMPENSATION SYSTEM
102 TRANSFORMER
104 HIGH VOLTAGE LINE
106 LOW VOLTAGE LINE
108 CONNECTION
110 CONTROLLER
112 POWER ELECTRONIC
114 CONTROLLABLE BRANCH/DEVICE
202 SENSOR
204 DC COMPONENT CONTROLLER
206 CONTROLLABLE BRANCH/DEVICE TRIGGER SET
208 POWER ELECTRONIC CONTROLLER
210 CONNECTION

The invention claimed is:

1. A method for compensating one or more DC components in an electrical system, the method comprising the following steps:

deriving one or more signals from the one or more DC components being present in a transformer having a core without a compensation winding, the transformer being connected to a high voltage line and a low voltage line;

receiving the one or more signals at one or more controllers;

converting the one or more signals into one or more firing pulses;

triggering one or more power electronics by using the one or more firing pulses;

connecting one or more controllable branches/devices in series with the transformer via the low voltage line; and charging the one or more controllable branches/devices to counterbalance the one or more DC components of the electrical system.

2. The method according to claim 1, which further comprises a step of sensing the one or more DC components by using one or more sensors before the step of receiving the one or more signals at the one or more controller.

3. The method according to claim 2, which further comprises a step of converting the one or more DC components in the one or more signals before the step of receiving the one or more signals at the one or more controller.

4. The method according to claim 1, which further comprises a step of synchronizing the one or more firing pulses according to one or more frequencies associated with the one or more power electronics before the step of triggering the one or more power electronics.

5. The method according to claim 1, which further comprises a step of synchronizing the one or more firing pulses according to one or more phases associated with the one or more power electronics before the step of triggering the one or more power electronics.

6. The method according to claim 1, wherein the transformer is a three phase transformer, and the one or more controllable branches/devices include a configuration of three delta connected coils each being connected to a respective phase winding of the three phase transformer.

7. A system for compensating one or more DC components in an electrical system, the system comprising:

one or more sensors for sensing the one or more DC components being present in a transformer having a core without a compensation winding, the transformer being connected to a high voltage line and a low voltage line, said one or more sensors outputting one or more signals;

one or more DC component controllers for generating one or more reference signals from the one or more signals received from said one or more sensors;

one or more controllers for generating one or more firing pulses from the one or more reference signals received from said one or more DC component controllers;

one or more controllable branch/deviccs branches/devices being connected in series with the transformer via the low voltage line; and one or more power electronics for charging said one or more controllable branches/devices to counterbalance the one or more DC components of the electrical system.

8. The system according to claim 7, which further comprises one or more trigger sets for synchronizing the one or more firing pulses received from said one or more controllers.

9. The system according to claim 7, wherein the transformer is a three phase transformer, and said one or more controllable branches/devices include a configuration of three delta connected coils each being connected to a respective phase winding of the three phase transformer.

* * * * *